United States Patent [19]

Levinson

[11] 4,306,133

[45] Dec. 15, 1981

[54] MICROWAVE PIE BAKING

[76] Inventor: Melvin L. Levinson, 1 Meinzer St., Avenel, N.J. 07001

[21] Appl. No.: 12,137

[22] Filed: Feb. 14, 1979

[51] Int. Cl.[3] ..... H05B 6/80

[52] U.S. Cl. ..... 219/10.55 E; 219/10.55 F; 426/107; 426/243

[58] Field of Search ..... 219/10.55 E, 10.55 M, 219/10.55 F; 426/107, 237, 241, 243, 242

[56] References Cited

U.S. PATENT DOCUMENTS

| | | | |
|---|---|---|---|
| 2,600,566 | 6/1952 | Moffett, Jr. | 219/10.55 E |
| 2,856,497 | 10/1958 | Rudenberg | 219/10.55 E |
| 3,539,751 | 10/1970 | Levinson | 219/10.55 E |
| 3,701,872 | 10/1972 | Levinson | 219/10.55 F |
| 3,731,037 | 5/1973 | Levinson | 219/10.55 E |
| 3,777,099 | 12/1973 | Levinson | 219/10.55 E |
| 3,854,023 | 12/1974 | Levinson | 219/10.55 E |
| 3,881,027 | 4/1975 | Levinson | 219/10.55 E X |
| 3,985,990 | 10/1976 | Levinson | 219/10.55 M X |
| 3,985,991 | 10/1976 | Levinson | 219/10.55 M X |
| 4,027,132 | 5/1977 | Levinson | 219/10.55 E |

*Primary Examiner*—Arthur T. Grimley

[57] ABSTRACT

An apparatus is described to bake meat or fruit pies with full top and bottom crusts while in their metal plates in a microwave oven. The pie is baked in an enclosure designed to contain said pie, in steam generated by said pie, while microwave energy, by direct exposure, simultaneously (1) bakes said pie's top crust and (2) converts to heat within a microwave-lossy heating element which heating element in contact with said metal pie plate, on heating, bakes said pie's bottom crust. Described are methods to create superheated steam and trap condensed water within said enclosure. Described are novel microwave-oven, microwave-lossy heating elements made of two metal sheets sandwiching a microwave-absorptive material.

5 Claims, 10 Drawing Figures

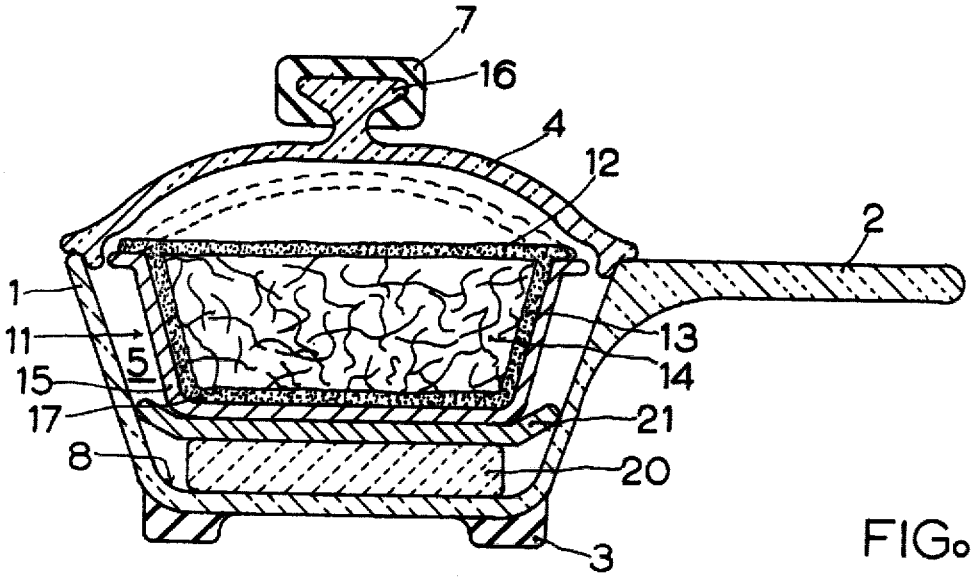
FIG. 6
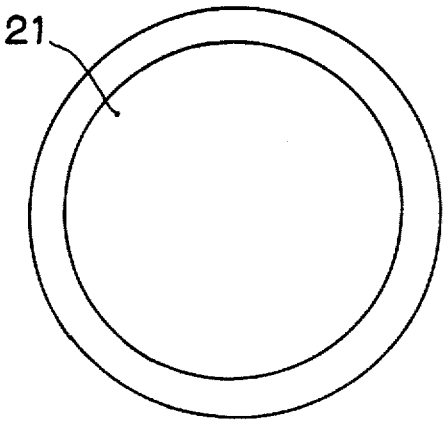
FIG. 7
FIG. 8
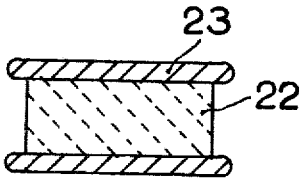
FIG. 9
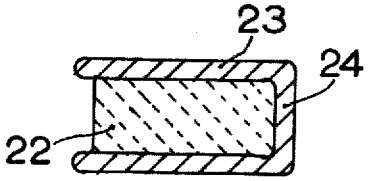
FIG. 10
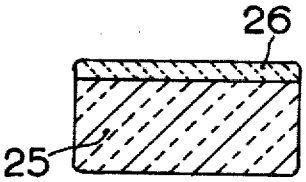

MICROWAVE PIE BAKING

BACKGROUND OF THE INVENTION

1. Field of the Invention

This invention concerns the defrosting and baking of frozen convenience pies with top and bottom crusts in a microwave oven and it concerns a novel baking utensil and novel heating elements for microwave cooking.

2. Description of Prior Art

To achieve the versatility of microwave cooking that is expected in gas and electric cooking, a microwave oven must be supplied with as many different type and size cooking utensils as are available for gas and electric cooking. Microwave oven cooking utensils should be specially designed to capitalize on microwave energy 's special characteristics and desirable cooking features. Numerous microwave cooking containers have been developed for microwave cooking, for example, my U.S. Pat. Nos. 3,539,751; 3,701,872; 3,731,037; 3,777,099; 3,985,990; 3,985,991; and 4,027,132.

My U.S. Pat. No. 3,731,037 teaches how to bake pies and how to employ a microwave-lossy, heat-insulating baking chamber to brown food. My U.S. Pat. No. 3,985,991 teaches using the latent heat of vaporization evolved from selectively heating one part of a food to heat a second part of said food. My U.S. Pat. Nos. 3,701,872 and 3,777,099 teach (1) how to use microwave-lossy heating elements in conjunction with metal cooking utensils and (2) ways of shielding condensed water and rendered by-products from further heating in a microwave oven in competition with a heating article. My U.S. Pat. No. 3,985,990 teaches how to trap evolved hot vapors evaporated from a food product by exposure to microwave energy and how to condense said hot vapor and thereby return its latent heat of vaporization to a heating system. Others, as in U.S. Pat. 2,714,070, have described apparatus which shields one area of an article from microwave exposure so as to provide selective heating of said article.

My U.S. Pat. No. 4,027,132, Microwave Pie Baking, concerns the baking of pies with full top and bottom crusts by employing a different structure than is here taught. This previous Microwave Pie Baking invention requires a two step operation (i.e. midway turning pie over and inserting said half baked pie in its paper pie plate into a metal pie plate) objectionable and complicated to some cooks.

SUMMARY OF THE INVENTION

It is an object of this invention to describe apparatus and methods to bake a pie with a full top and bottom crust in a microwave oven without auxiliary gas and electric heating elements.

It is a further object of this invention to describe apparatus and methods to defrost and bake a frozen convenience pie with a full top and bottom crust in a microwave oven without auxiliary gas and electric heating elements.

It is a further object of this invention to describe new microwave-lossy heating elements for a microwave oven and describe the use of microwave-lossy heating elements in conjunction with a vapor condensing system.

In the apparatus and methods of this invention a pie, in its metal pie plate, is placed on a special heating element within an enclosure designed to contain steam at a positive vapor pressure and thereafter is exposed to microwave energy within a microwave oven. Whereupon said pie is surrounded by steam and (1) the top crust of said pie is baked by direct exposure to microwave energy and (2) the bottom crust is baked by heat conducted thereto by said metal pie plate. Said heat conducted to said bottom crust is generated in said microwave-lossy heating element during exposure to said microwave energy. Steam evolved during the baking of the top crust condenses on the sides of the metal pie plate heating the pie crust in contact with said metal pie plate. After exchanging through the metal of the pie plate its heat for the cold of the pie, the steam condenses to a liquid on the outside of said metal pie plate and thereupon falls by gravity to contact said heating element where it boils off and as super heated steam recycles. Steam condensing on the cold walls of said enclosure, on the option of the operator, is either trapped away from active exposure to said microwave energy or further boiled and recycled.

BRIEF DESCRIPTION OF THE DRAWING

FIG. 6 is a cross section of a second embodiment of the invention shown with a pie in an aluminum foil pie plate therein.

FIG. 7 is a top view of a metal tray designed to support the pie shown on the heating element illustrated in FIG. 6.

FIG. 8 is a cross section of another embodiment of the heating element in FIG. 6.

FIG. 9 is another embodiment of the heating element shown in FIG. 6.

FIG. 10 is a cross section of another embodiment of the heating element shown in FIG. 6.

DESCRIPTION OF THE PREFERRED EMBODIMENTS

Figure 1:
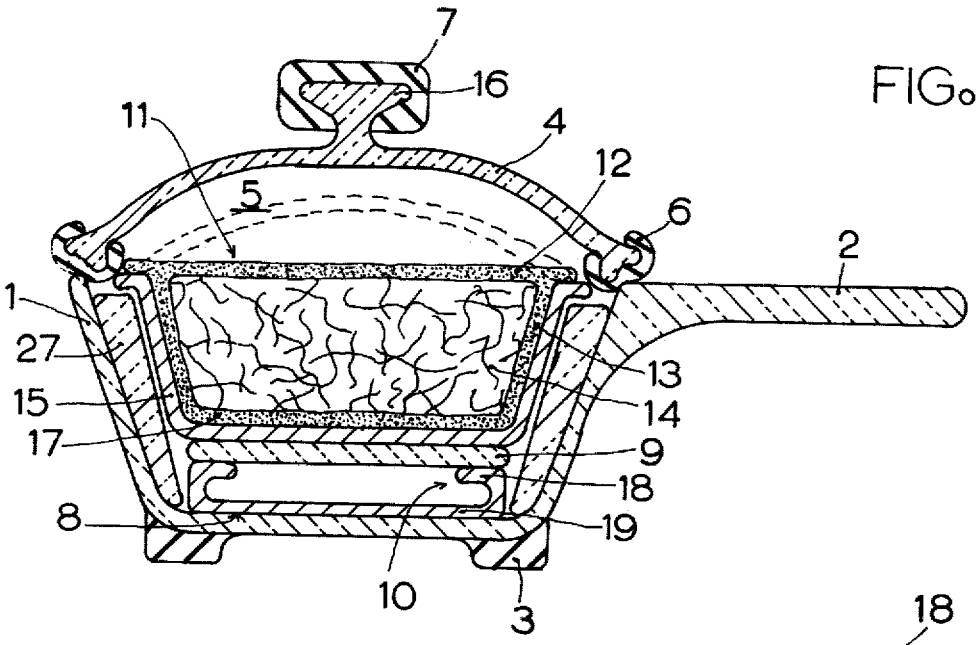
FIG. 1 is a cross section of one embodiment of the invention shown with a pie in an aluminum foil pie plate therein.

FIG. 1 illustrates container 1 with handle 2 and feet 3. Cover 4 mates with container 1 to impede the free release of steam from container 1 and, in operation, to permit a build up of a positive vapor pressure within a baking chamber 5 defined by container 1 and cover 4. Around the periphery of cover 4 is gasket 6 and on cover 4 is knob 7.

Figure 2:
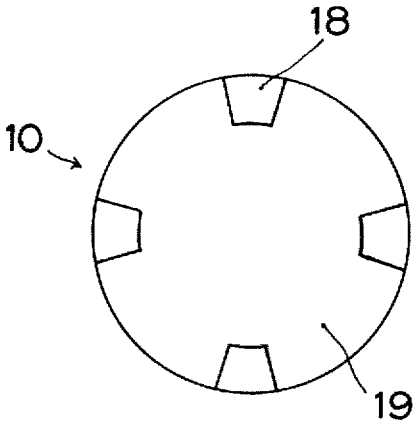
FIG. 2 is a top view of a special metal member designed to support the heating element of FIG. 1.
Figure 3:
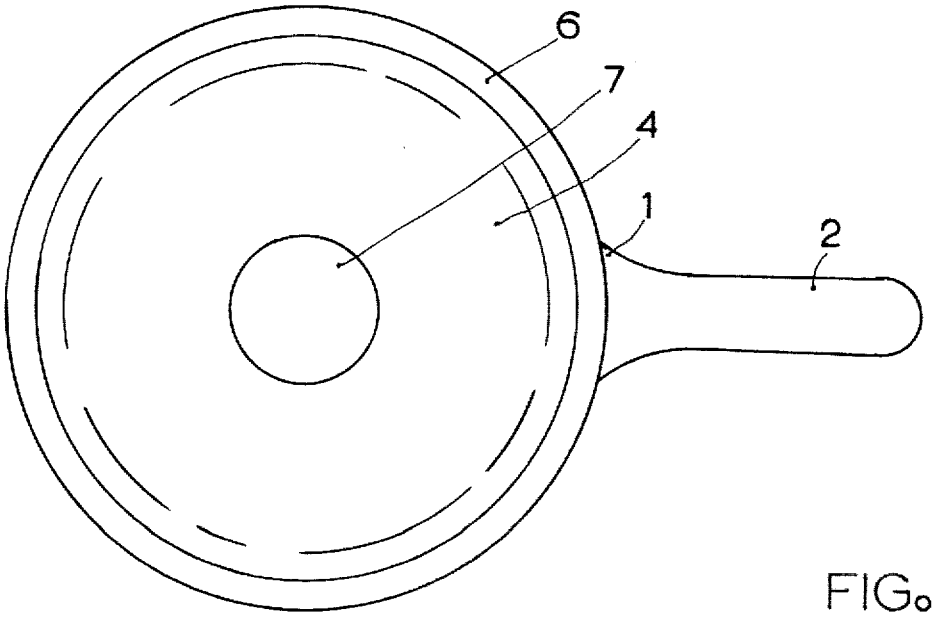
FIG. 3 is the top view of FIG. 1.
Figure 4:
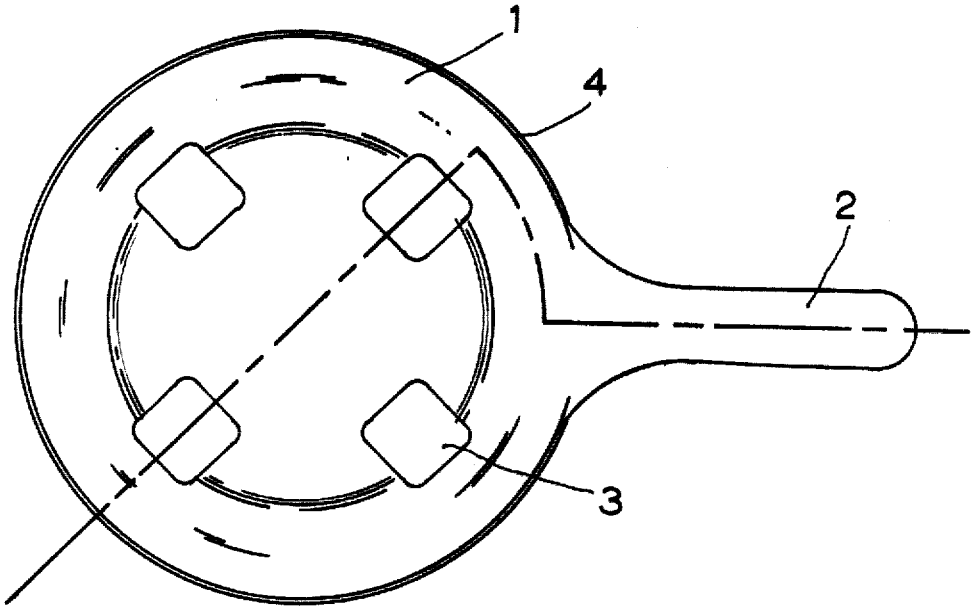
FIG. 4 is the bottom view of FIG. 1.

On floor 8 of container 1 rests metal member 10, consisting of flat element 19 and side supports 18—18, supporting heating element 9 thereon. Illustrated is a well known 8 oz. frozen convenience pie 11 with top crust 12, side crust 13 and bottom crust 17 with meat or fruit filling 14 therein all in an aluminum foil pie plate 15 supported by heating element 9. FIG. 2 is a top view of metal member 10 to illustrate one way in which side supports 18—18 can attach to metal element 19.

Gasket 6 and insulating knob 7 are molded to mate with and hold to cover 4 by elastic action. Gasket 6 and insulating knob 7 are best made of a microwave-permeable, microwave-non-lossy, elastic, heat-insulating, high-temperature, mechanical-shock-absorbing material as silicone rubber. Silicone rubber gasket 6 and knob 7 can be individually molded and then can be stressed apart to respectively fit over the periphery of cover 4 and knob receptor 16, released and fixed there by elastic action. This use of elastic action to hold on both gasket 6 and knob 7 is preferred for it makes gasket 6 and knob 7 replaceable if cover 4 or gasket 6 are damaged in use. Alternately, uncured silicone rubber can be applied directly to cover 4 and cured thereon. The invention does not require gasket 6, per se, as a simple good mating cover 4 and container 1 is all that is necessary. Cover 4 is best made of a microwave-permeable, light-transparent material as borosilicate glass.

Container 1 is best made of a microwave-permeable, microwave-non-lossy material, as glass-ceramic. Feet 3 are best made of a heat-insulating, microwave-non-lossy, mechanical-shock-resistant, high-temperature material as silicone rubber.

Heating element 9 is a microwave-lossy, substantially-non-water-porous, relatively-good-heat-conductive material, having high electrical, mechanical and thermal shock resistance, as Carbofrax, a silicon carbide composition, manufactured by the Carborundum Company. Carbofrax material is used as an (electric) arc shield as it does not support an electric arc from its surface to an adjacent metal material when subject to a voltage difference therebetween as would an equal amount of silicon carbide, per se. Carbofrax's heat conducting properties approach that of some metals.

Metal member 10 (i.e. element 19 and said supports 18—18) is made of a heat-conducting, microwave-reflective material, as aluminum, and, if reusable, is preferably manufactured of such gauge as to be easily scoured and/or washed in a dishwasher.

Figure 5:
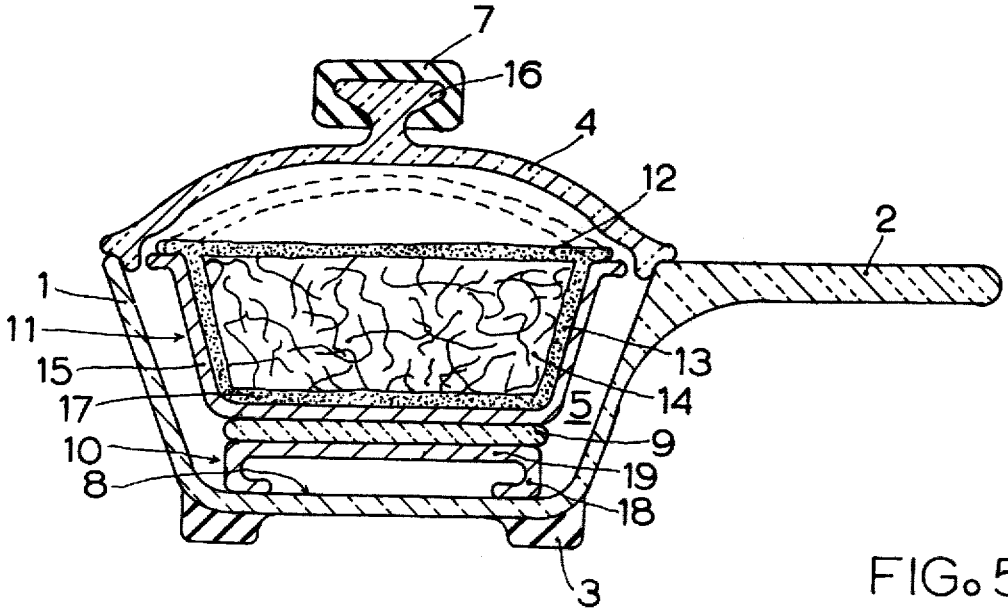
FIG. 5 is a cross section view of the embodiment shown in FIG. 1 wherein the metal support element holding the heating element is employed inverted.

FIGS. 1, 5 and 6 have common purpose (e.g. to bake a pie with a full top and bottom crust in its metal pie plate in a microwave oven) and result (e.g. in one microwave oven operation to defrost a frozen convenience meat or fruit pie and heat it to appear and taste as if it had been baked in a gas or electric oven).

In gas and electric baking, heat is conducted from the crust of a pie to its filling regardless of the temperature of the filling. Besides surface heating, microwave pie baking adds (1) deep heating, (2) different fillings heating at different rates in relation to the crust and (3) selective heating where frozen and unfrozen portions of the same filling heat at different rates resulting in spot heating (e.g. localized thermal runaways). Said another way, in microwave baking, the results baking a pie with a meat filling may be different than the results realized baking a pie with a fruit filling. A cherry filling tends to react differently than would a blueberry or apple filling for the same formulation of crust. The variables described added to variables as oven ambient temperatures have made baking a pie in a microwave oven difficult.

The baker with practice and the proper selection of apparatus and methods can enhance or suppress the effects of microwave spot and selective heating (e.g. a fruit pie filling heating at a different rate than would a meat pie filling). To simultaneously brown top and bottom crust and defrost and heat the filling in the embodiments of FIGS. 1 and 5, different size microwave-lossy heating elements 9 can be provided for the baker so that the baker can chose a smaller size for a meat pie and a larger size for a fruit pie. In the embodiment of FIG. 6 the microwave heating element 20, by design, is made purposely large where its can be 50% to 150% of the weight of pie 11. In use the large heating element 20, of FIG. 6, receives and converts to heat the preponderance of the available microwave energy. The top crust acts to convert to heat the majority of the remaining microwave energy so that little microwave energy is left to reach the filling. By this discovery different type pie fillings tend to heat alike in the same time. With each increase in the mass-lossiness of heating element 20, heating element 20 converts a greater proportion of the available microwave energy into baking heat so that the baker's concern becomes more the weight of the pie to the weight of the heating element in contrast to his previous concern over the type filling and other such variables. The drawback of using large heating elements is the larger the heating element the longer the time required to bake a given pie. Note, if heating element 20 weighs the same amount as pie 11, the baking period is increased substantially for the heavy heating element 20 and metal member 21 (in FIG. 6) must reach the required browning temperature.

The baker must consider what browness (e.g. color) is required of the baked crust and, on reaching said required browness, what minimum temperature is desirable for the pie's filling. The baker must choose the proper configuration of apparatus, the method of its use and the size of the heating element which will provide the results he desires.

In operation, in FIG. 1, frozen pie 11, in aluminum pie plate 15, resting on heating element 9, in baking chamber 5 of container 1, is exposed to microwave energy. Whereupon, microwave energy is initially principally converted to heat in pie crust 12 and heating element 9. The pie crust defrosts and heats to a temperature circa 212° F. whereupon said pie crust releases hot vapors. As the process continues water in said pie crust boils and hot steam, contained by cover 4 and gasket 6, fills heating chamber 5 to a positive vapor pressure. Before said steam can build to a pressure high enough to escape covered container 1, said steam must raise every exposed cold surface in container 1 and its contents above its dew point by condensing to a liquid thereon. The amount of steam and energy required to raise the temperature of chamber 5's walls above their dew point is small as said walls are a poor heat conductor. In contrast with chamber 5's heat insulating walls, aluminum pie plate 15's side walls are heat conductive and in thermal contact with frozen pie 11 and require a lot of energy to raise their temperature above their dew point. Water condensing from steam impinging on the outside of aluminum pie plate 15 falls by gravity into contact with heating element 9. Initially, heating element 9 boils off said water, but, as less water falls thereon (e.g. aluminum pie plate heats higher than its dew point), heating element 9 acts to change into superheated steam the water and steam impinging thereon as it rises to browning temperatures.

It is well known that superheated steam has a drying (i.e. baking) effect on anything on which it impinges. Said superheated steam impinging on aluminum pie plate 15 adds heat to that conducted thereto from heating element 9 to brown bottom and side pie crusts 13 and 17. Any water condensed from steam by cover 4 and container 1 which drops by gravity to the bottom of baking chamber 1 is, on option, trapped (not recycled) by landing in close proximity with microwave-shielding metal element 19. In FIG. 5, by design any water that tries to accumulate on bottom 8 is quickly boiled away by exposure to microwave energy and from being heated by contacting metal side supports 18—18 which supports have been heated by conducting heat from the large surface of metal element 19 in contact with heating element 9.

In FIG. 6, the operation differs from FIGS. 1 & 2 in that large heating element 20 (corresponding to small heating element 9 of FIGS. 1 & 2) is structured to weigh close to the weight of the pie it is designed to bake. Interposed between heating element 20 and aluminum pie plate 15 is metal saucer 21. In this embodiment, because of the size and mass of large heating element 20 and metal saucer 21 relative to the size of pie 11, on exposure to microwave energy, the microwave energy expends itself in large proportion in heating element 20. Because of its size heating element 20 would quickly burn bottom pie crust 17 before top crust 12 has a chance to bake if not for the interposition of metal saucer 21 and the boiling off of condensed water which water falls from metal pie plate 15 into saucer 21. Condensed water, which falls by gravity off cover 4 and the sides of container 1, contacts hot large heating element 20 and is recycled as superheated steam. Note that the boiling off of condensed water cools large heating element 20, where without said cooling, heating element 20 could easily reach temperatures which would burn pie 11. Metal saucer 21, besides providing even heating and recycling water, is disposed to catch any filling 14 boiling out of metal pie plate 15 during baking. Final cleanup is simplified by metal saucer 21's function of catching boiled-over filling. If boiled-over filling is permitted to contact heating element 20 it will burn thereon with accompanying smoke and difficulty of clean up.

Superheated steam acts as a heat insulating, drying blanket encompassing pie 11. Steam, per se, is relatively microwave-non-lossy. Pie 11's crust is heated hotter than said steam blanket by microwave energy passing through said steam blanket, converting to heat energy in said pie's top crust and said heat energy being trapped in said crust. Pie 11's pie crust quickly rises and reaches browning temperatures.

Employing large heating element 20 rather than small heating element 9 means a baker need pay less attention to variables (e.g. type pie filling, ambient temperatures, etc.). Large heating element 20's mass and lossiness are a constant which dominates the heating process. While it appears that large heating element 20 would always be preferred as less consideration has to be given to pie variables, in practice, a baker may consistently choose small heating element 9 of FIG. 1. In FIG. 1, by trapping a portion of the condensed water by metal member 10 and, since only a small proportion of the available microwave energy is required to heat up small heating element 9 to its browning temperature, a baking process using small heating element 9 is faster than one using large heating element 20. For example, using a one ounce heating element 9 vs. a five ounce large heating element 20 could result in an eight ounce pie baked in nine minutes vs. the same pie in the same oven taking thirteen minutes to bake utilizing large heating element 20. If enough trials are made to choose exactly the right weight for a small heating element 9, for a particular type pie of a particular manufacturer, said heating element 9 will just heat up enough to properly brown said pies crust whereupon, at the end of the baking period, heating element 9 will cool to a temperature below the browning (burning) temperature of said bottom crust and will thereupon act to keep said pie hot for longer periods of time useful in delayed service of said pie.

Feet 3 protect a serving surface which ultimately receives the baked pie in container 1 and, also, does not permit container 1 to cool by physical contact with either a cool oven floor or a cool oven shelf (both not shown).

In FIG. 8, heating element 9 and metal member 10 are shown as fabricated as one unit with heating element 22 sandwiched between two metal plates 23—23. In FIG. 9, the metal plates 23—23 of FIG. 8 are connected together on one side by a heat conducting metal element 24 so that the heat generated in the bottom of heating element 9 is conducted faster to the top of heating element 9.

FIG. 10 illustrates an alternate fabrication of large heating element 20 where heating material 26 is bonded to a heat-insulating material 25. For example, a heating material 29 of Carbofrax bonded to a heat-insulating material 25 as Mullite manufactured by Carborundum Company or nested in a heat-insulating material 25 as foamed fused silica.

Note that in FIGS. 1, 5, 8 and 9 a microwave-lossy material is disposed between two electrical conducting members. The purpose and result is that of a microwave capacitor with a lossy dielectric which heats on exposure to microwave radiation. The top plate of the heating element of FIGS. 8 and 9 contacts the bottom of the aluminum pie plate and both pieces of metal touching one another in effect become electrically one. Any arcing therebetween only adds heat to a heating element.

As an option, in FIG. 1, to better heat-insulate the side walls 15 of pie 11 so that they bake more uniformly, there is illustrated a heat-insulating member 27 surrounding pie 11. Heat-insulating member 27 can be a hollow cone of borosilicate glass open at its top and bottom. Heat insulating member 27 serves additional purpose in that, in snugly fitting pie 11's side walls, any boil over of filling 14 out of pie 11 is blocked from falling by gravity onto hot heating element 9 and burning thereon. It is expected that some will wish to incorporate the function of heat-insulating material 27 into the structure of container 1.

I prefer to surface defrost and wet most frozen foods before exposing them to microwave energy in a microwave oven. This surface defrosting and wetting of frozen foods is more fully described in my copending application, U.S. Ser. No. 4324, filed Jan. 17, 1979. Surface defrosting and wetting of the top crust of a frozen pie in its aluminum container prior exposure of said pie to microwave radiation in a apparatus of this invention can result in a more uniformly baked crust (e.g. less possibility of spot heating).

Although this invention has been described with a certain degree of particularity, it should be understood that the present disclosure has been made only by way of example and that numerous changes in the details of construction and in the combination and arrangement of parts and in the methods described may be resorted to without departing from the spirit and scope of the invention.

I claim:

1. Apparatus to bake, in a metal pie plate, a pie with a full top and bottom crust in a microwave oven which comprises:

a microwave-permeable, heat-insulating container whose inner walls and floor define a chamber to bake said pie therein, a microwave-lossy heating member within said chamber to heat by conduction, at least, the bottom of said metal pie plate when said pie in its metal pie plate is baked thereon, and metal means to support said heating member in a spaced relationship above the floor of said chamber.

2. Apparatus to bake a pie, according to claim 1, which includes: where said metal means to support said heating element includes a member remote from said heating element which is designed to shield microwave lossy liquid in said remote member's immediate proximity from direct exposure to microwave radiation.

3. Apparatus to bake a pie, according to claim 1, which includes: microwave-permeable, heat-insulating means added beneath said heating member.

4. Apparatus to bake, in a metal pie plate, a pie with a full top and bottom crust in a microwave oven which comprises:

a microwave-permeable, heat-insulating enclosure designed to bake a pie therein, a microwave-lossy heating member within said enclosure which weighs between 50% and 150% of said pie's weight, and a metal member with a first surface in contact with said microwave-lossy member and a second surface designed to contact, at least, the bottom of said metal pie plate when said pie is baked within said enclosure.

5. Apparatus to bake a pie, according to claim 4, which includes: where said metal member is fabricated and disposed so as to prevent any filling which boils out of said pie during an exposure to microwave radiation from directly contacting said heating member.

* * * * *